US005769658A

United States Patent [19]

Glazier

[11] Patent Number: 5,769,658

[45] Date of Patent: Jun. 23, 1998

[54] JUMPER CABLE APPARATUS

[76] Inventor: LaDell O. Glazier, 1233 W. 6930 S., Spanish Fork, Utah 84660

[21] Appl. No.: 694,035

[22] Filed: Aug. 8, 1996

[51] Int. Cl.[6] ..... H01R 11/00

[52] U.S. Cl. ..... 439/504

[58] Field of Search ..... 439/504, 503, 439/506, 623, 624

[56] References Cited

U.S. PATENT DOCUMENTS 4,286,172 8/1981 Millonzi et al. ..... 439/504

4,496,204 1/1985 Conley ..... 439/504

*Primary Examiner*—P. Austin Bradley

*Assistant Examiner*—Barry Matthew L. Standig

[57] ABSTRACT

A new Jumper Cable Apparatus for ensuring the safe performance of the operation of jump starting a vehicle with a weakened battery. The inventive device includes one cable element, whether negative or positive, of greater length than the other, and additional insulated areas on the cable for use in securing a clamp.

5 Claims, 3 Drawing Sheets

PRIOR ART

JUMPER CABLE APPARATUS

BACKGROUND OF THE INVENTION

1. Field of the Invention

The present invention relates to battery jumper cables and more particularly pertains to a new Jumper Cable Apparatus for ensuring the safe performance of the operation of jump starting a vehicle with a weakened battery.

2. Description of the Prior Art

The use of battery jumper cables is known in the prior art. More specifically, battery jumper cables heretofore devised and utilized are known to consist basically of familiar, expected and obvious structural configurations, notwithstanding the myriad of designs encompassed by the crowded prior art which have been developed for the fulfillment of countless objectives and requirements.

Known prior art battery jumper cables include U.S. Pat. No. 4,897,044; U.S. Pat. No. 4,272,142; U.S. Pat. No. 5,230,637; U.S. Pat. No. 5,291,977 and U.S. Pat. No. 4,869,688.

While these devices fulfill their respective, particular objectives and requirements, the aforementioned patents do not disclose a new Jumper Cable Apparatus. The inventive device includes one cable element, whether negative or positive, of greater length than the other, and additional insulated areas on the cable for use in securing a clamp.

In these respects, the Jumper Cable Apparatus according to the present invention substantially departs from the conventional concepts and designs of the prior art, and in so doing provides an apparatus primarily developed for the purpose of ensuring the safe performance of the operation of jump starting a vehicle with a weakened battery.

SUMMARY OF THE INVENTION

In view of the foregoing disadvantages inherent in the known types of battery jumper cables now present in the prior art, the present invention provides a new Jumper Cable Apparatus construction wherein the same can be utilized for ensuring the safe performance of the operation of jump starting a vehicle with a weakened battery.

The general purpose of the present invention, which will be described subsequently in greater detail, is to provide a new Jumper Cable Apparatus apparatus and method which has many of the advantages of the battery jumper cables mentioned heretofore and many novel features that result in a new Jumper Cable Apparatus which is not anticipated, rendered obvious, suggested, or even implied by any of the prior art battery jumper cables, either alone or in any combination thereof.

To attain this, the present invention generally comprises one cable element, whether negative or positive, of greater length than the other, and additional insulated areas on the cable for use in securing a clamp.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Modification of Battery Jumper Cables apparatus and method which has many of the advantages of the battery jumper cables mentioned heretofore and many novel features that result in a new Jumper Cable Apparatus which is not anticipated, rendered obvious, suggested, or even implied by any of the prior art battery jumper cables, either alone or in any combination thereof.

It is another object of the present invention to provide a new Jumper Cable Apparatus which may be easily and efficiently manufactured and marketed.

It is a further object of the present invention to provide a new Jumper Cable Apparatus which is of a durable and reliable construction.

An even further object of the present invention is to provide a new Jumper Cable Apparatus which is susceptible of a low cost of manufacture with regard to both materials and labor, and which accordingly is then susceptible of low prices of sale to the consuming public, thereby making such Jumper Cable Apparatus economically available to the buying public.

Still yet another object of the present invention is to provide a new Jumper Cable Apparatus which provides in the apparatuses and methods of the prior art some of the advantages thereof, while simultaneously overcoming some of the disadvantages normally associated therewith.

Still another object of the present invention is to provide a new Jumper Cable Apparatus for ensuring the safe performance of the operation of jump starting a vehicle with a weakened battery.

Yet another object of the present invention is to provide a new Jumper Cable Apparatus which includes one cable element, whether negative or positive, of greater length than the other, and additional insulated areas on the cable for use in securing a clamp.

Still yet another object of the present invention is to provide a new Jumper Cable Apparatus that prevents the metal jaws from accidentally touching each other and creating an electrical short circuit.

Even still another object of the present invention is to provide a new Jumper Cable Apparatus that helps eliminate sparks and the possibility of battery explosion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
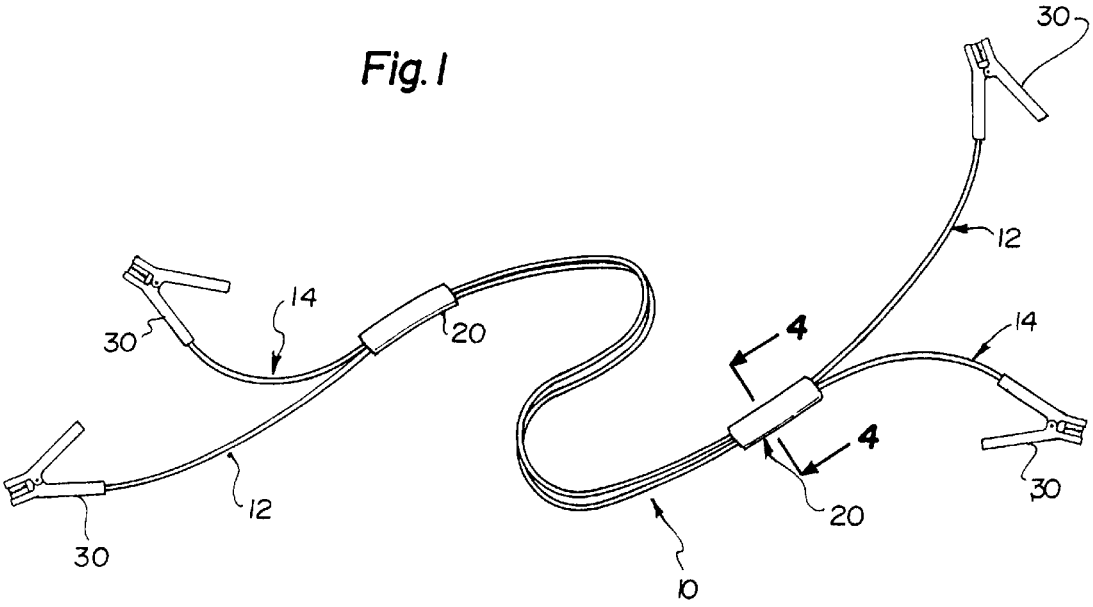
FIG. 1 is a plan view of a new Jumper Cable Apparatus according to the present invention.

With reference now to the drawings, and in particular to FIGS. 1 through 6 thereof, a new Jumper Cable Apparatus embodying the principles and concepts of the present invention and generally designated by the reference numeral 10 will be described.

More specifically, it will be noted that the Jumper Cable Apparatus 10 comprises electrical cable means, insulating means and clamping means.

Figure 2:
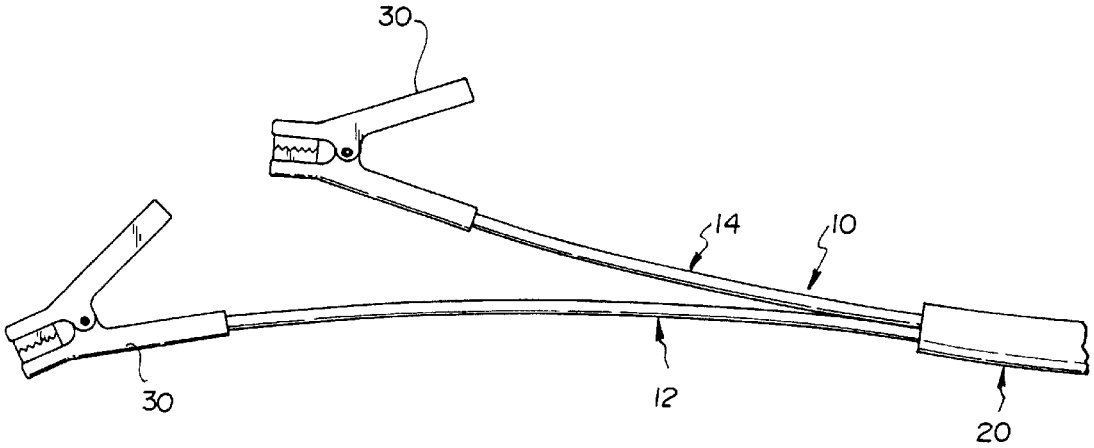
FIG. 2 is a plan view on enlarged scale showing one end of the new Jumper Cable Apparatus shown in FIG 1.

Referring to FIG. 1, numeral 10 indicates the battery jumper cable apparatus which includes a pair of electrical cables 12 and 14, with cable 12 shown to be longer than cable 14 (FIG. 2). Each end of each cable includes a clamp 30 for connecting the cables to the terminals of a battery.

Figure 4:
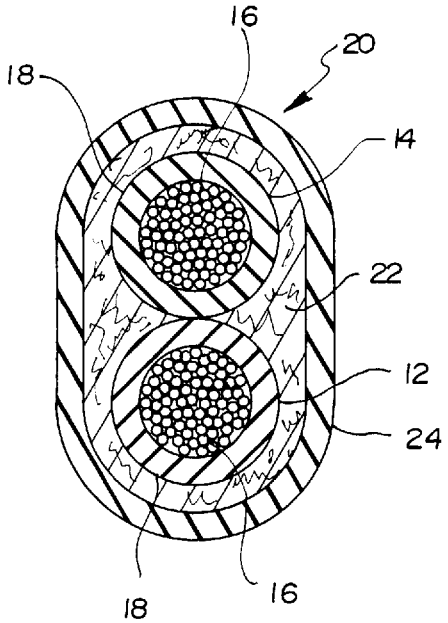
FIG. 4 is a cross sectional view taken along line 4—4 of FIG 1.

Connected to the pair of cables are two insulated sections 20. Referring to FIG. 4, the insulated sections consist of an insulator 24 which surrounds a packing material 22. The insulator 24 and packing material 22 surround the pair of cables comprised of conductors 16 insulated by insulators 18.

Figure 3:
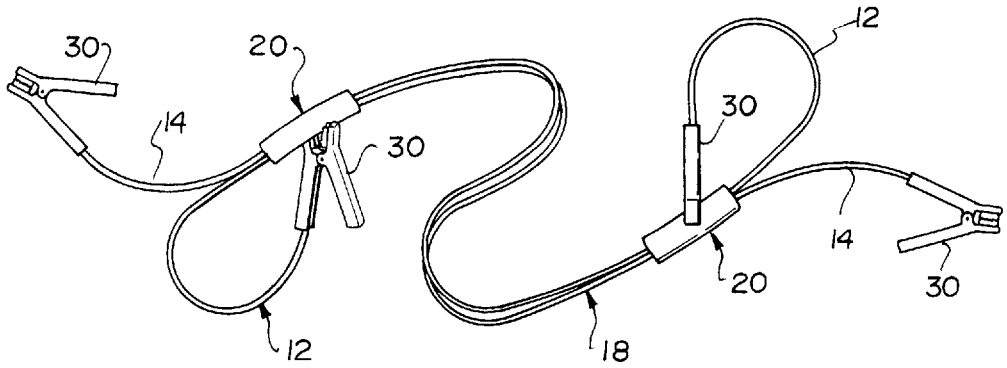
FIG. 3 is perspective view of the invention showing clamps secured to the insulated areas.

Referring to FIG. 3, the insulated sections 20 afford a safe place to secure the clamps connected to cable 12 while cable 14 is being connected to the batteries in the jump start operation.

Figure 5:
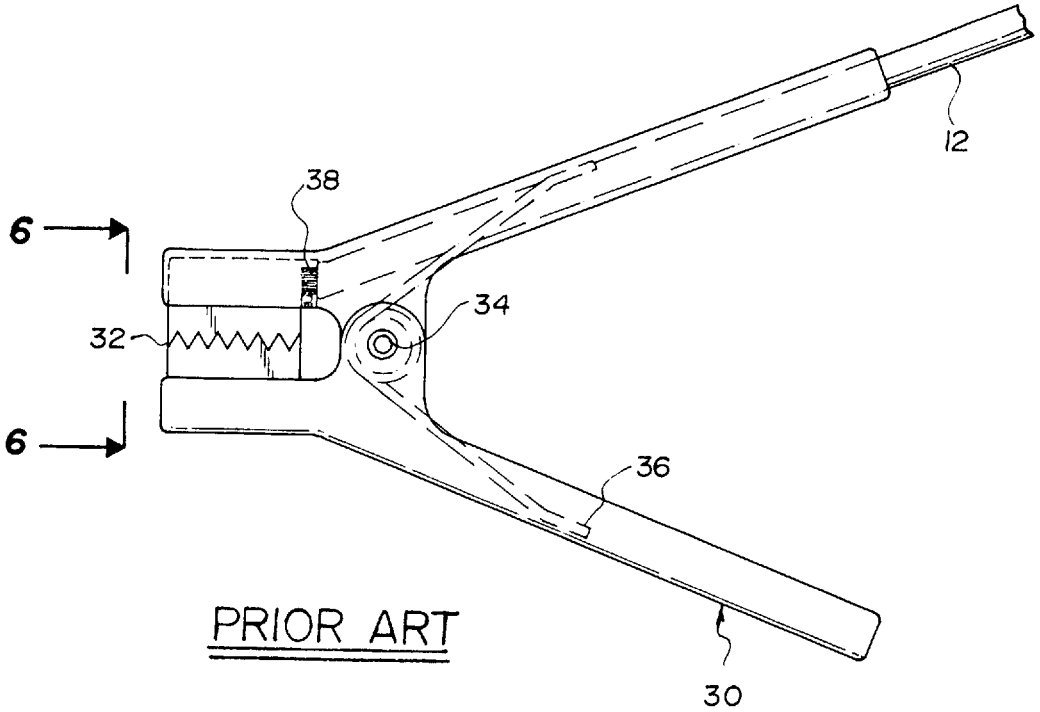
FIG. 5 is a plan view of a prior art clamp.
Figure 6:
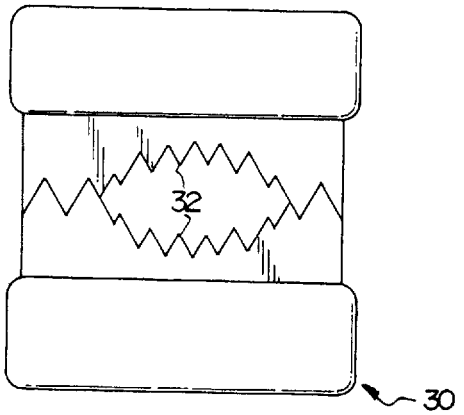
PRIOR ART Fig. 6
FIG. 6 is a cross sectional view taken along line 6—6 of prior art FIG 5.

The cable 12 in FIG. 5 is affixed to the clamp 30 by means of set screw 38. The jaws of the clamp 30 pivot around a rivet 34 and are held in place by means of spring 36. Teeth 32 are provided (FIG. 6) to secure contact between the clamp and a battery post.

In use, the Jumper Cable Apparatus is used by first clamping the shorter of the two cables to the battery posts while the longer cable clamps are secured to the insulating areas on the cable. The longer cable is then clamped to the remaining battery posts and the vehicle jump started.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jumper cable apparatus comprising a first electrical cable having opposite ends;

a second electrical cable having opposite ends and a length longer than the first electrical cable; said first and second electrical cables each having a layer of insulative material formed about said electrical cable and extending substantially the entire length from one end to the other end of said cable;

a clamping means mounted on each said end of the first and second electrical cables for clamping on an object in an electrically conducting relationship;

at least two protective tubular bands looped about both the first and second electrical cables at spaced locations along said electrical cables, each said protective tubular band being located at a distance from a pair of ends of said first and second electrical cables sufficient to permit the clamping means mounted at the nearest ends of the electrical cables to be clamped onto said protective tubular band, said tubular band having sufficient wall thickness to protect the insulative material of the electrical cables from damage from the clamping means; and packing material located between the insulative material on said electrical cable and the interior of each said protective tubular band to provide additional protection to the insulative material from the clamping means.

2. The jumper cable apparatus of claim 1 wherein the clamping means comprises a scissors clamp having a pair of pivoting arms pivotally linked together.

3. The jumper cable apparatus of claim 1 wherein the length of each said electrical cable between said protective tubular band and said clamping means forms a free length, and wherein said protective tubular band is slidable along the length of said electrical cables to permit adjustment of the free length of each said cable adjacent to the end of the cable.

4. The jumper cable apparatus of claim 1 wherein each said clamping means has a length dimension, and each said protective tubular band has a length substantially equal to the length of the clamping means to permit sufficient spacing of clamping means clamped on said tubular band to avoid contact between the clamping means.

5. A jumper cable apparatus comprising:

a first electrical cable having opposite ends;

a second electrical cable having opposite ends and a length longer than the first electrical cable; said first and second electrical cables each having a layer of insulative material formed about said electrical cable and extending substantially the entire length from one end to the other end of said cable;

a clamping means mounted on each said end of the first and second electrical cables for clamping on an object in an electrically conducting relationship;

at least two protective tubular bands looped about both the first and second electrical cables at spaced locations along said electrical cables, each said protective tubular band being located at a distance from a pair of ends of said first and second electrical cables sufficient to permit the clamping means mounted at the nearest ends of the electrical cables to be clamped onto said protective tubular band, said tubular band having sufficient wall thickness to protect the insulative material of the electrical cables from damage from the clamping means; and packing material located between the insulative material on said electrical cable and the interior of each said protective tubular band;

wherein the clamping means comprises a scissors clamp having a pair of pivoting arms pivotally linked together;

wherein the length of each said electrical cable between said protective tubular band and said clamping means forms a free length, and wherein said protective tubular band is slidable along the length of said electrical cables to permit adjustment of the free length of each said cable adjacent to the end of the cable; and wherein each said clamping means has a length dimension, and each said protective tubular band has a length substantially equal to the length of the clamping means to permit sufficient spacing of clamping means clamped on said tubular band to avoid contact between the clamping means.

* * * * *